United States Patent [19]

Mitomi et al.

[11] Patent Number: 5,017,969

[45] Date of Patent: May 21, 1991

[54] DEVICE HAVING MOVABLE BELT

[75] Inventors: Tatsuo Mitomi; Yoshihiko Hirose, both of Yokohama, Japan

[73] Assignee: Canon Kabushiki Kaisha, Tokyo, Japan

[21] Appl. No.: 357,778

[22] Filed: May 30, 1989

[30] Foreign Application Priority Data

May 30, 1988 [JP] Japan ..... 63-131949
Jul. 15, 1988 [JP] Japan ..... 63-177756

[51] Int. Cl.[5] ..... G03G 15/16; G03G 15/01

[52] U.S. Cl. ..... 355/271; 355/212; 198/835; 198/840

[58] Field of Search ..... 355/212, 271, 275, 326, 355/327; 198/835, 840

[56] References Cited

U.S. PATENT DOCUMENTS 4,008,801 2/1977 Reilly et al. ..... 198/840 X
4,077,510 3/1978 Müller ..... 198/840
4,407,580 10/1983 Hashimoto et al. ..... 355/275
4,627,702 12/1986 Anderson ..... 355/212

FOREIGN PATENT DOCUMENTS 57-60347 4/1982 Japan ..... 355/271
59-184379 10/1984 Japan ..... 355/271
63-100477 5/1988 Japan ..... 355/212

*Primary Examiner*—Joan H. Pendegrass
*Attorney, Agent, or Firm*—Fitzpatrick, Cella, Harper & Scinto

[57] ABSTRACT

A device having a movable belt for transporting, for example, a recording medium, at least one rotary body around which the belt is wound so as to be supported thereon, and limiting portions or members for limiting the movement of the belt in the axial direction of the rotary body. The device is designed to stabilize the movement of the belt by making the friction between the limiting members smaller than the friction between the belt and the rotary body.

12 Claims, 7 Drawing Sheets

DEVICE HAVING MOVABLE BELT

BACKGROUND OF THE INVENTION

1. Field of the Invention

This invention relates to a device having a movable belt and, more particularly, to an image forming apparatus such as an electrophotography apparatus or laser beam printer having a movable belt and capable of recording image information on an image support member such as a transfer material.

2. Related Background Art

Conventional color electrophotography copiers based on electrophotography using a plurality of image formation processing steps to form a color image make use of several types of systems a typical one of which is illustrated in FIG. 5.

A color electrophotography copier shown in FIG. 5 has four image forming stations Pa to Pd each of which has rotary photosensitive drums 1*a* to 1*d* provided as image bearing members. Around the photosensitive drums 1*a* to 1*d* are respectively disposed charging sections 2*a* to 2*d*, exposure sections 3*a* to 3*d*, development sections 4*a* to 4*d*, transfer sections 5*a* to 5*d* and cleaning sections 6*a* to 6*d* in the direction of rotation of the drums.

A transfer belt means including an endless belt, i.e., a transportation means 7 is disposed below the photosensitive drums 1*a* to 1*d* so as to pass through the image forming stations Pa to Pd. The transportation belt means 7 transports, through the transfer sections 5*a* to 5*d* of the image forming stations Pa to Pd, a transfer sheet 9 supplied by paper feed rollers 8 disposed at its one end.

Formation of a color image with the thus-constructed color electrophotography copier will be described below. A latent image of an original image in a yellow component color is formed on the photosensitive drum 1*a* by using the charging section 2*a* and exposure section 3*a* of the first image forming station Pa, i.e., by a well-known electrophotography means, this latent image is changed into a visible image at the development section 3*a* by a developer containing a yellow toner, and, at the transfer section 4*a*, the yellow toner image thereby made visible is transferred to the transfer sheet 9 transported by the transportation belt means 7.

During transfer of the yellow toner image to the transfer sheet 9, a latent image of the original image in a magenta component color is formed on the photosensitive drum 1*b* in the second image forming station Pb in the same manner as the yellow toner image, and a magenta toner image is obtained at the development section 4*b* by using a magenta toner. When the transfer sheet 9 to which the yellow toner image has been transferred in the first image forming station Pa is transported to the transfer section 5*b* of the second image forming station Pb, the magenta toner image is transferred to the transfer sheet 9 at a predetermined position.

With respect to cyan and black colors, image formation is effected in the same manner. After superposition of the four color toner images on the transfer sheet 9 has been completed, the transfer sheet 9 is transported to a fixation section 10 disposed at the other end of the transportation belt means 7, and the color images are fixed in this section, thereby obtaining a multi-color (full-color) image on the transfer sheet 9.

After transfer, an amount of toner remaining on each of sensitive drums 1*a* to 1*d* is removed by the corresponding one of the cleaning means 6*a* to 6*d*, thereby preparing each drum for the subsequent latent image formation.

This type of full-color image forming apparatus has the following advantages.

(1) It has independent stations for forming images in respective colors, and is therefore effective for speedup of image formation.

(2) The transfer path can be formed along a straight line and the apparatus is therefore applicable to formation of an image even on a thick sheet of paper or a transparent film.

However, this type of image forming apparatus entails a most serious drawback relating to how the desired performance of registration of the color images formed in the different image forming stations is achieved. Offsets between the positions at which the four color images are formed by transfer to the transfer sheet (hereinafter referred to as "registration offset") finally appear as color offsets or changes in hues. One of the causes of such a registration offset relates to a phenomenon of one-sided movement of the transportation belt of the transportation belt means 7 (transportation belt 100 (FIG. 6)) for transferring the transfer sheet as a result of failure to effect a straight-line motion, i.e., a phenomenon of meandering of the transportation belt 100 or deviation of the same from a predetermined course on the rollers for rotating, retaining and guiding the transportation belt 100.

A means for correcting such an offset of the transfer belt, i.e., the transportation belt 100 is known which includes a guide groove formed in each of guide rollers which rotate, retain and guide the transportation belt, and a guide rib formed on the transportation belt at the position corresponding to the guide groove.

This kind of means which essentially consists of guide grooves in the guide rollers and a guide rib on the transportation belt and which is thus provided as a simple mechanism can limit the offset of the transportation belt and is also advantageous in terms of durability because, even though the thickness of transportation belt is small, the thrust force is applied to the end surface of the guide rib improved in strength.

The color electrophotography copier shown in FIG. 5 is also provided with a guide rib 101A formed at one end of a belt base fabric 100A, and guide grooves 11A to 14A formed in transportation belt guide rollers 12 to 14 and in a transportation belt drive roller 11 provided to drive the transportation belt 100, the guide grooves being formed at predetermined positions corresponding to the guide rib 101A on the belt base fabric 100A, as shown in FIG. 6. (Guide grooves 13A and 14A are not illustrated.) The guide rib 101A is fitted in these guide grooves, thereby determining the path for the transportation belt while maintaining the linearity of the movement of the transportation belt.

In the conventional offset correcting means or transportation belt meandering correcting means including rollers having guide grooves and a belt having a guide rib, the surface of the drive roller is formed from a material having a comparatively large friction coefficient $\mu$, e.g., rubber in order to improve the efficiency with which the driving force is transmitted to the transportation belt. Also, a thin belt is adopted as the transportation/transfer belt in consideration of the performance of transfer and adhesion to the transfer sheet, and the guide rib fixed to the belt is formed of a rubber having a smaller rigidity in order to avoid any considerable influence on the flexibility of the transportation belt. Therefore the material of the guide rib has a friction coefficient $\mu$ as large as that of the surface of the drive roller.

If a belt having such a guide rib is wound around the rollers and is moved by the drive roller, the side surface of the guide rib slides on the mating side surface of the guide groove of each roller to prevent the transportation belt from meandering. It is possible that a portion of the side surface of the guide rib may be pressed against the side surface of one of the guide grooves. If this state continues for a long period of time, a large frictional resistance occurs between the side surfaces of the guide rib and the guide groove, because both friction coefficients of the rubber forming the surface of the roller and the rubber forming the guide rib are large. The desired sliding performance of the guide rib is thereby impaired, and the speed at which the transportation belt is moved for transportation is thereby changed. If the side surface of the guide rib further continues sliding on the side surface of the guide groove, there is a possibility of the guide rib riding on the surface of the roller, thereby impairing the linearity of the movement of the transportation belt.

This phenomenon causes a reduction in the area of contact between the transportation belt and the drive roller and allows flying toner to attach to the surface of the roller so as to reduce the friction coefficient of this surface. Transmission of the driving force to the transportation belt is thereby made considerably unstable. In consequence, a registration offset takes place and causes blur of a color or a change in a hue, resulting in a deterioration in the qualities of the image.

To stop the guide rib from floating from the roller, the tension applied to the transportation belt may be increased. However, if the tension is excessively large and if the guide rib and the transportation belt are formed of resins, a creep strain may be caused such that portions of the guide rib and the transportation belt which are in contact with the rollers during stoppage of the apparatus are deformed, resulting in failure to perform a smooth transportation movement of the transportation belt. Moreover, because the elogation of the portion of the transportation belt on which the guide rib is fixed is different from that of other portion, an excessive stress is caused in the portion to which the guide rib is fixed, resulting in a reduction in the lifetime of the transportation belt.

SUMMARY OF THE INVENTION

In view of the above-described problems, an object of the present invention is to provide a device having a movable belt capable of being moved stably with improved reliability by limiting changes in its speed.

Another object of the present invention is to provide a device having a movable belt which is prevented from floating from a rotary body around which the belt is wound so as to be supported thereon.

Still another object of the present invention is to provide a device having a belt capable of being moved smoothly for a long period of time without causing any considerable creep strain in its portion, i.e., without being deformed.

A further object of the present invention is to provide a device having a belt capable of being moved stably and smoothly by being prevented from one-sidedly moving or meandering.

A still further object of the present invention is to provide an image forming apparatus having a belt or, more specifically, a transfer sheet transporting belt and capable of obtaining an image improved in qualities by moving the belt smoothly and stably so as to prevent occurrence of registration offsets.

To achieve these objects, the present invention provides in one of its aspects a device having a movable belt, at least one rotary body around which the belt is wound so as to be supported thereon, and a limiting means for limiting the movement of the belt in the axial direction of the rotary body, wherein the friction coefficient of the limiting means is smaller than the coefficient of friction between the belt and the rotary body.

The present invention provides in another of its aspects a device having a movable belt, at least one rotary body around which the belt is wound so as to be supported thereon, and a limiting member for limiting the movement of the belt in the axial direction of the rotary body by contacting the belt, the limiting member being loosely fitted to the rotary body.

DESCRIPTION OF THE PREFERRED EMBODIMENTS

Preferred embodiments of the present invention will be described below with reference to the accompanying drawings.

Figure 3:
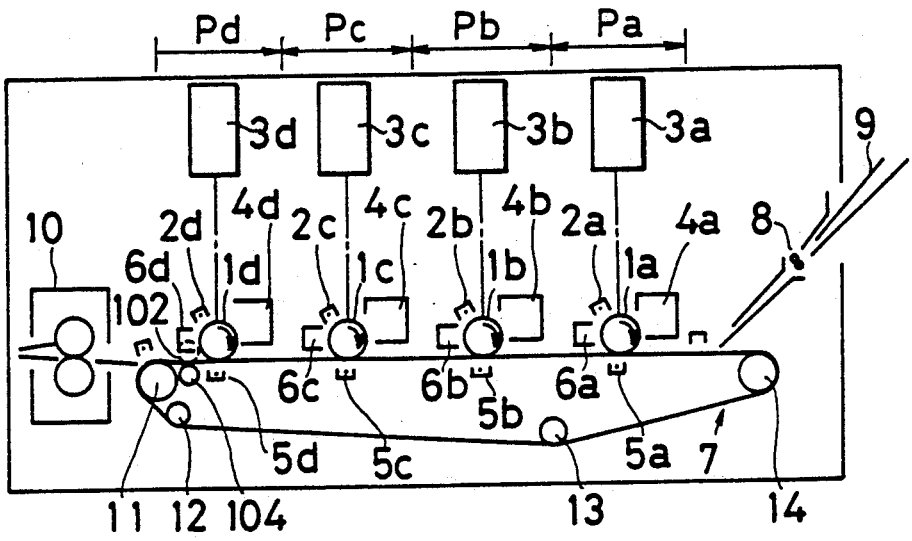
FIG. 3 is a schematic cross-sectional view of an image forming apparatus to which the present invention is applied.

Referring first to FIG. 3, a color image forming apparatus or a color electrophotography copier to which the present invention is applied is illustrated. The electrophotography apparatus has four image forming stations Pa to Pd each of which has rotary photosensitive drums 1*a* to 1*d* provided as image bearing members. Around the photosensitive drums 1*a* to 1*d* are respectively disposed charging sections 2*a* to 2*d*, exposure sections 3*a* to 3*d*, development sections 4*a* to 4*d*, transfer sections 5*a* to 5*d* and cleaning sections 6*a* to 6*d* in the direction of rotation of the drums.

A transfer belt means including an endless belt, i.e., a transportation device 7 is disposed below the photosensitive drums 1*a* to 1*d* so as to pass through the image forming stations Pa to Pd. The transportation belt device 7 transports, through the transfer sections 5*a* to 5*d* of the image forming stations Pa to Pd, a transfer sheet 9 supplied as a medium for recording an image by paper feed rollers 8 disposed at its one end.

A color image is formed by the thus-constructed color electrophotography copier as described below. A latent image of an original image in a yellow component color is formed on the photosensitive drum 1*a* by using the charging section 2*a* and exposure section 3*a* of the first image forming station Pa, i.e., by an image forming means based on well-known electrophotography technique, this latent image is changed into a visible image at the development section 3*a* by a developer containing a yellow toner, and, at the transfer section 4*a*, the yellow toner image thereby made visible is transferred by a transfer means such as an illustrated corona discharge device to the transfer sheet 9 transported by the transportation belt device 7.

During transfer of the yellow toner image to the transfer sheet 9, a latent image of the original image in a magenta component color is formed on the photosensitive drum 1*b* in the second image forming station Pb in the same manner as the yellow toner image, and a magenta toner image is obtained at the development section 4*b* by using a magenta toner. When the transfer sheet 9 to which the yellow toner image has been transferred in the first image forming station Pa is transported to the transfer section 5*b* of the second image forming station Pb, the magenta toner image is transferred by a corona discharge device to the transfer sheet 9 at a predetermined position.

With respect to cyan and black colors, image formation is effected in the same manner. After superposition of the four color toner images on the transfer sheet 9 has been completed, the transfer sheet 9 is transported to a fixation section 10 disposed at the other end of the transportation belt device 7, and the color images are fixed in this section, thereby obtaining a multi-color (full-color) image on the transfer sheet 9.

After transfer, an amount of toner remaining on each of the sensitive drums 1*a* to 1*d* is removed by the corresponding one of the cleaning means 6*a* to 6*d*, thereby preparing each drum for the subsequent latent image formation.

The transportation belt device for transporting a transfer sheet used in the color image forming apparatus will be described below with reference to FIGS. 1 and 2.

Figure 2:
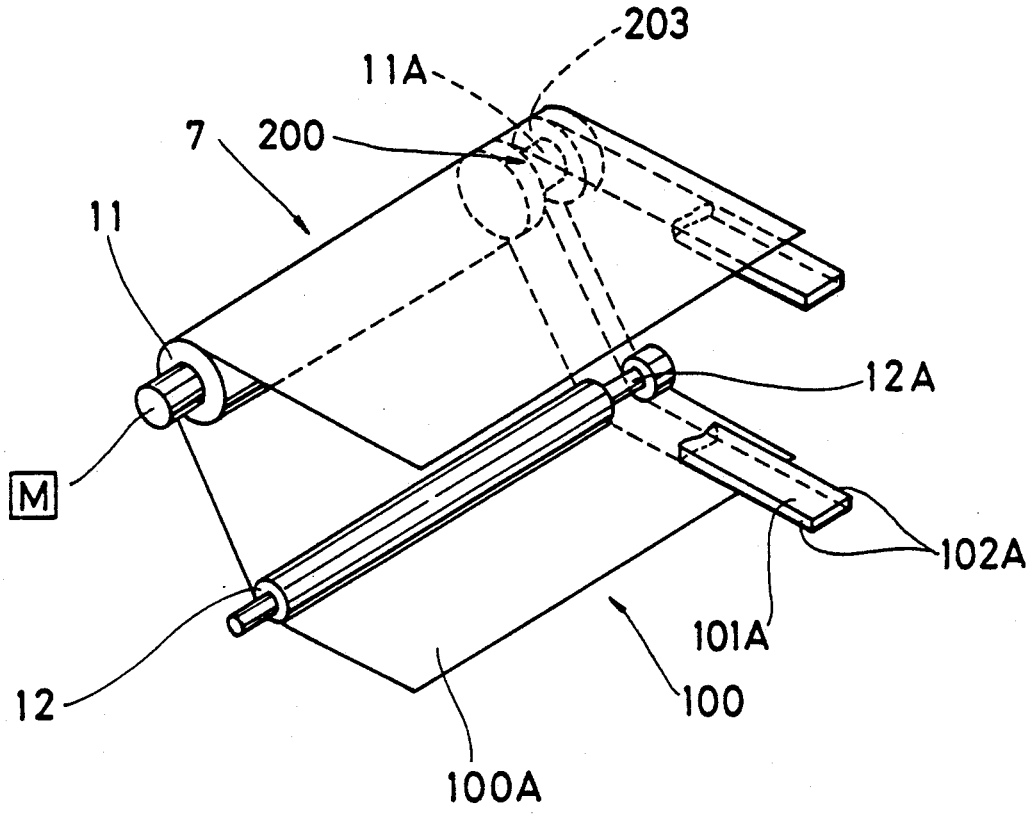
FIG. 2 is a schematic perspective view of a portion of the transfer belt in accordance with the embodiment.

As shown in FIG. 2, the transportation belt device 7 has an endless transportation belt 100 (transfer belt) which is wound around a drive roller 11 and transportation belt guide/retention rollers 12 to 14 and is operated by the rotation of the drive roller 11 driven by a drive motor M. A guide rib 101A is bonded to a lengthwise side portion of a belt base fabric of the transportation belt 100 on the inner peripheral side thereof and outside a region in which recording is effected on the recording medium, i.e., a region in which transfer to the recording medium is effected. Guide grooves 12A to 14A for engagement with the guide rib 101A are formed in the rollers 12 to 14 for guiding the retaining the transportation belt at predetermined portions corresponding to that of the guide rib 101A. (Guide grooves 13A and 14A are not illustrated.) The guide rib 101A may be bonded to the belt base fabric 100A by an adhesive or the like or may be integrally connected to the base fabric 100 by ultrasonic welding or the like. In this embodiment, the belt base fabric 100A is formed of an urethane resin or the like which is preferable in terms of adhesion and transfer performance of the transfer sheet, and the guide rib 101A is formed from an urethane rubber having a certain degree of elasticity and having fatigue-proof properties. However, the materials of the belt base fabric and the guide rib are not limited to these examples and may be of any kind so long as they have the above properties.

The transportation belt device 7 will be further described with reference to FIGS. 1A and 1B which illustrate a state in which the transportation belt 100 with the guide rib 101A of the transportation belt device 7 is wound around the drive roller 11.

Figure 1A:
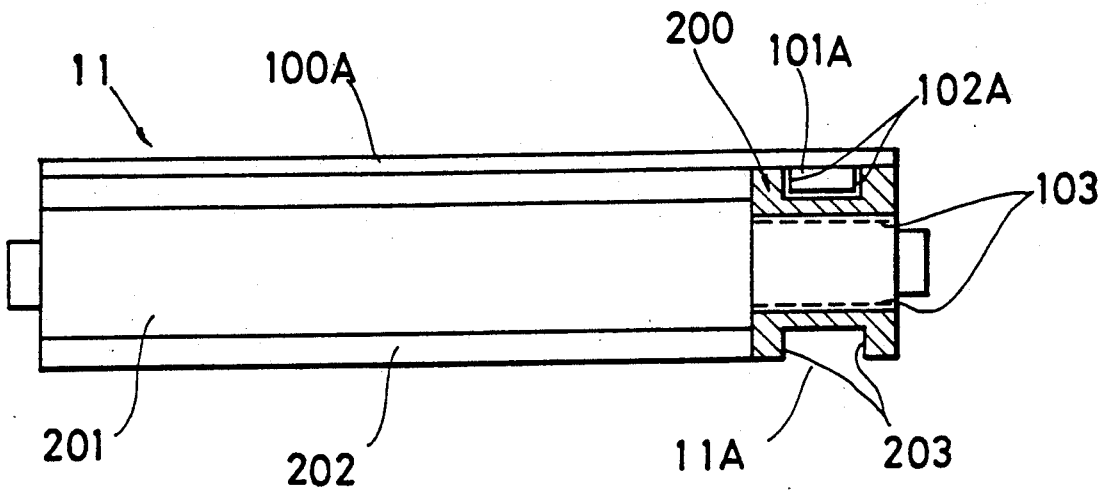
FIGS. 1A and 1B are schematic cross-sectional views of a drive roller of a transfer belt means which represents an embodiment of the present invention.
Figure 1B:
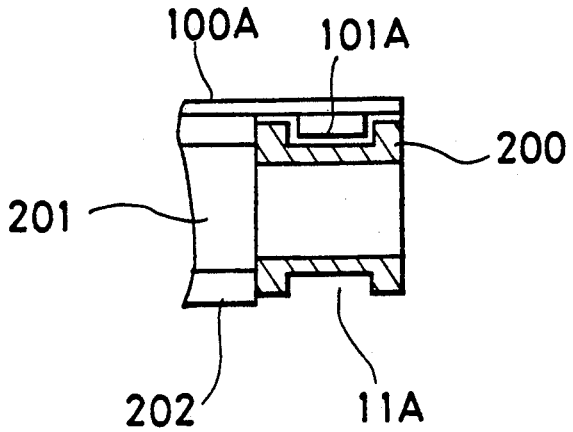

As shown in FIGS. 1A and 1B, the drive roller 11 has a two-layer structure consisting of a metallic core 201 and a rubber layer 202 formed on the metallic core 201. The coefficient $\mu 1$ of friction between the rubber layer 202 and the belt 100 is comparatively small. The rubber layer 202 is fixed on the metallic core 201 in a press-fitting manner. A guide groove member 200 having a guide groove 11A is provided at one extreme end of the drive roller 11 coaxially therewith. The position of the guide groove 11A relative to the drive roller 11 is selected so that it corresponds to the guide rib 101A disposed outside the transfer region and that the guide groove 11A can engage with the guide rib 101A, as in the case of the other guide grooves 12 to 14. That is, the guide grooves formed in the rollers 11 to 14 are located outside the region in which transfer is effected. Each of side surfaces 102A of the guide rib 101A which serves as a limiting portion capable of limiting the movement of the transportation belt in the longitudinal direction of the drive roller 11 can be brought into contact with one of side surfaces 203 of the guide groove member 200.

The guide groove member 200 fitted to the drive roller 11 is fixed to one extreme end of the metallic core 201 of the drive roller 11 in a bonding or press-fitting manner, or it is loosely fitted to the drive roller 11, as indicated by the broken line in FIG. 1A so as to be rotatable relative to the drive roller 11. To effect this loose fitting, the inside diameter of the guide groove member provided as a limiting member is made larger than the outside diameter of the mating shaft portion. The guide groove member 200 may be formed from, for example, a plastic and may be formed from any material so long as a coefficient $\mu 2$ of friction between the side surface 102A of the guide rib and the side surface 203 of the guide groove member 200, that is, a friction coefficient $\mu 2$ of the limiting portions 102A and 203 is smaller that the friction coefficient $\mu 1$.

The outside diameter of the guide groove member 200 fitted to one extreme end of the metallic core 201 of the drive roller 11 may be the same as the outside diameter of the drive roller 11, as shown in FIG. 1A, or may be slightly smaller than the latter, as shown in FIG. 1B. The guide rib 101A is fitted in the guide groove 11*a* of the guide groove member 200 attached to one extreme end of the drive roller 11 in such a manner that, as shown in FIGS. 1A and 1B, the inner surface of the guide rib 101A does not contact the bottom surface of the guide groove 11A. The width of the guide groove 11A is selected in consideration of the straightness of the guide rib 101A bonded to the transportation belt so that it is larger than the width of the guide rib 101A, and that a certain clearance is provided between the side surfaces of the guide groove 11A and the guide rib 101A.

In this embodiment, as described above, the coefficient $\mu 2$ of friction between the side surface 203 of the guide groove member 200 and the side surface 102A of the guide rib 101A of the transportation belt to be fitted in the guide groove 11A, i.e., the friction coefficient of the limiting portions 102A and 203 is smaller than the coefficient $\mu 1$ of friction between the rubber layer 202 of the drive roller 11 and the transportation belt 100. As a result, the frictional resistance between the side surface 102A of the guide rib 101A and the side surface 203 of the guide groove 11A generated when the transportation belt is driven while inserting the guide rib 101A in the guide groove 11A becomes reduced, thereby improving the performance of sliding the guide rib 101A as well as improving the durability of the transportation belt 100.

Drawbacks which are experienced when the friction coefficient $\mu 2$ is equal to or larger than the friction coefficient $\mu 1$ are therefore eliminated. It is thereby possible to prevent the guide rib from riding on the roller surface and to achieve stable running of the transportation belt without impairing the essential functions of the guide rib of correcting offset of the transportation belt and of preventing meandering of the same. The lifetime of the transfer belt can therefore be extended. Also, the desired performance of formation of good images free from color offsets or changes in hues can be maintained for a long period of time, thus remarkably improving the reliability of the image forming apparatus.

The present invention is not limited to the above-described embodiment and can be modified in other various ways without departing from its scope and spirit.

Figure 4:
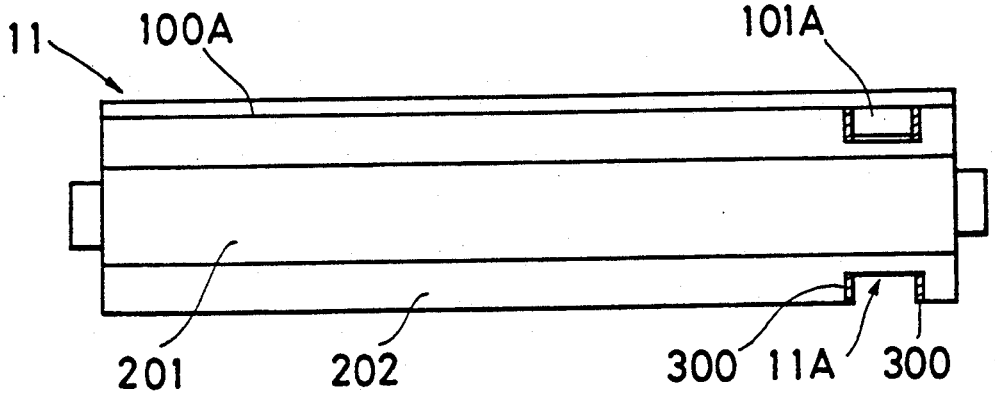
FIG. 4 is a schematic cross-sectional view of a drive roller of a transfer belt means which represents another embodiment of the present invention.
Figure 5:
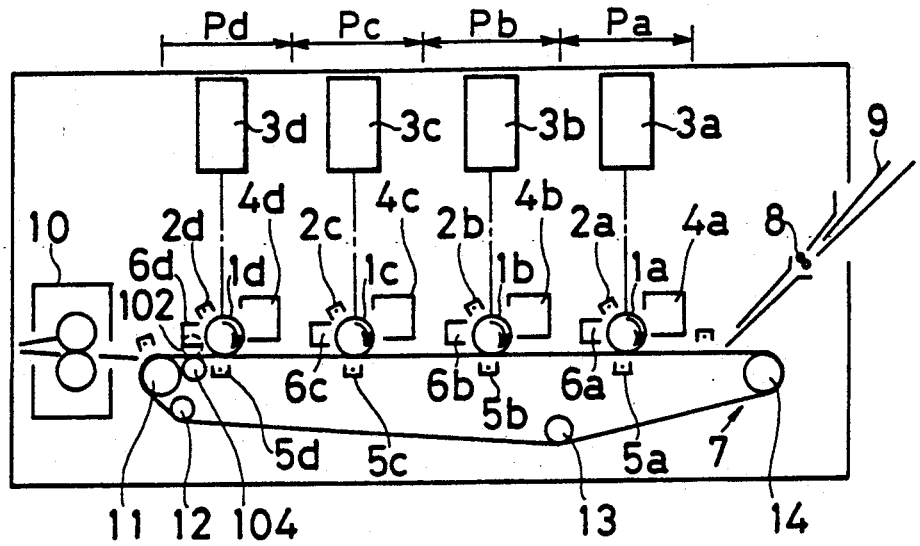
FIG. 5 is a schematic cross-sectional view of a conventional image forming apparatus.
Figure 6:
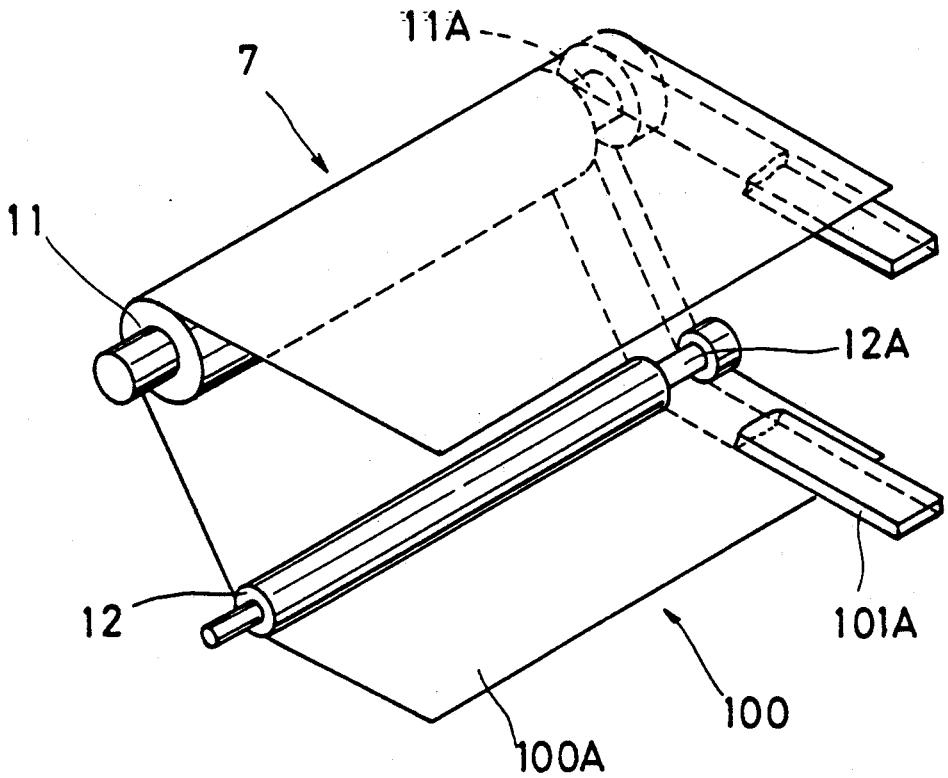
FIG. 6 is a schematic perspective view of a portion of a transfer belt means for use in the conventional image forming apparatus.

For example, in the arrangement shown in FIG. 4, a drive roller 11, which has a two-layer structure consisting of a metallic core 201 and a rubber layer 202 fixed on the metallic core 201 in a press-fitting manner as in the case of the above-described embodiment, has a guide groove 11A formed in its one extreme end portion, and two pairs of friction reducing members 300 in the form of ring halves fitted to opposite side surfaces of the guide groove 11A. This arrangement relating to the guide groove differs from that of the above-described embodiment. The limiting portions of this arrangement correspond to the side surfaces of the guide rib and the friction reducing members 300.

Another arrangement in which the friction reducing members 300 are bonded to the opposite side surfaces of the guide groove 11A also enables the same effects as the above-described embodiment.

The friction reducing members 300 may be formed of a polyacetal resin such as polyoxymethylene or may be formed of any material on condition that the friction coefficient $\mu 2$ of the limiting portions is smaller than the friction coefficient $\mu 1$.

A still another embodiment of the present invention will be described below with reference to FIGS. 7 and 8. Components or portions identical to those of the described embodiments are indicated by the same reference characters and the description for them will not be repeated.

Figure 7:
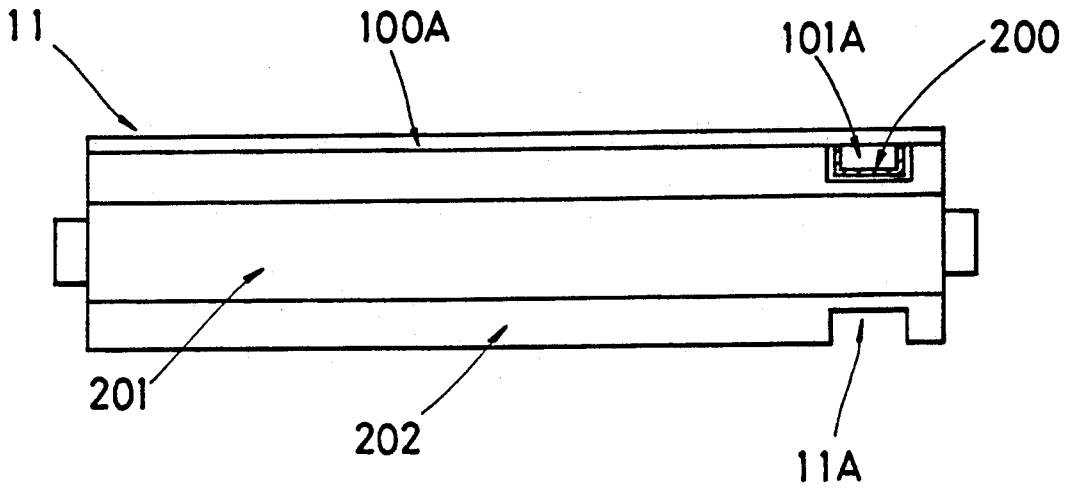
FIG. 7 is a schematic cross-sectional view of a drive roller of a transfer belt means which represents still another embodiment of the present invention.
Figure 8:
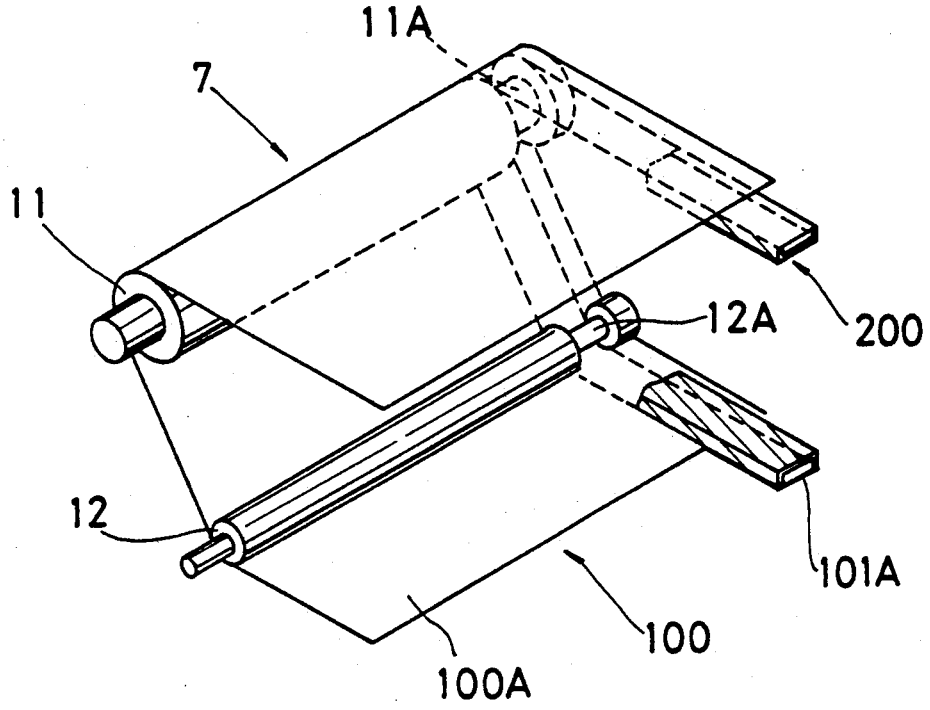
FIG. 8 is a schematic perspective view of a transfer belt in accordance with a further embodiment of the present invention.

As shown in FIGS. 7 and 8, opposite side surfaces of the guide rib 101A bonded to the belt base fabric 100A are coated with Teflon (commercial name) used as a friction reducing material so as to form extremely thin coating layers 200. The inner surface of the guide rib 101A may be coated with Teflon but this coating is not always necessary.

The coating material is not limited to Teflon but any material can be used to form the coating on condition that the coefficient $\mu 2$ of friction between the side surfaces (friction reducing members) of the guide rib 101A and the side surfaces of the guide groove 11A serving as limiting portions for limiting the movement of the transportation belt 100 in the longitudinal direction of the drive roller 11 is adequately smaller than the coefficient $\mu 1$ of friction between the rubber layer 202 and the belt 100.

The guide groove **11*a* of the guide groove member 200 attached to one extreme end of the drive roller 11 and the coated guide rub 101A fitted in the guide groove 11A are positioned relative to each other in such a manner that, as shown in FIG. 7, the inner surface of the guide rib 101A does not contact the bottom surface of the guide groove 11A, and that a certain clearance is provided between the side surfaces of the guide groove 11A and the guide rib 101A in consideration of the straightness of the guide rib 101A by making the width of the guide groove 11A larger than that of the guide rub 101A** bonded to the transportation belt.

As described above, the relationship between the guide groove 11A and the guide rib 101A of the transportation belt 100 fitted in the guide groove 11A is such that a guide groove 11A is formed in one end portion of the drive roller 11 outside the transfer region and that the guide rib 101A coated with Teflon is fitted in the guide groove 11A. It is thereby possible to reduce, by virtue of the Teflon coating layer 200, the frictional resistance caused between one of the side surfaces of the guide rib 101A and the corresponding side surface of the guide groove when these surface are slide on and contact each other. The sliding performance of the guide rib 101A is thereby improved and the durability of the guide members is also improved, thereby stabilizing the movement of the transportation belt.

It is therefore possible to prevent the drawback of the conventional device, i.e., to prevent the guide rib from riding on the roller surface and to achieve stable running of the transportation belt without impairing the essential functions of the guide rib of correcting offset of the transportation belt and of preventing meandering of the same. The lifetime of the transfer belt can therefore be extended. Also, the desired performance of forming good images free from color offsets or changes in hues can be maintained for a long period of time, thus remarkably improving the reliability of the image forming apparatus.

Figure 9A:
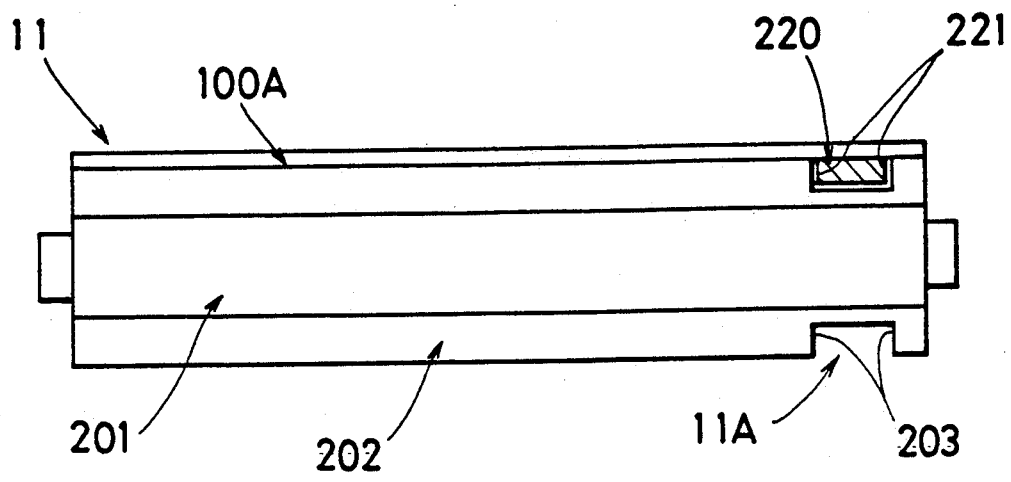
FIG. 9A is a schematic cross-sectional view of a drive roller of a transfer belt means which represents a still further embodiment of the present invention.

FIG. 9A shows a further embodiment of the present invention.

In this embodiment, the transportation belt means 7 is constructed in such a manner that the drive roller 11 has a two-layer structure consisting of a metallic core 201 and a rubber layer 202 fixed on the metallic core 201 in a press-fitting manner in the same manner as the above-described embodiment. However, the transportation belt means 7 of this embodiment differs from that of the first embodiment in that the drive roller 11 has a guide groove 11A formed in its one extreme end portion, and that a guide rib 220 provided as a small friction member and fitted in the guide groove 11A is formed of a material such as fluorine rubber which is elastic and has a comparatively smaller friction coefficient. The provision of the guide rib 220 formed of such a material also enables the same effects as the above-described embodiments.

The small friction member 220 may be formed of any material on condition that the coefficient $\mu 2$ of friction between side surfaces 221 of the guide rib 220 and side surfaces 203 of the guide groove 11A serving as limiting portions is smaller than the coefficient $\mu 1$ of friction between the rubber layer 202 and the belt 100.

Figure 9B:
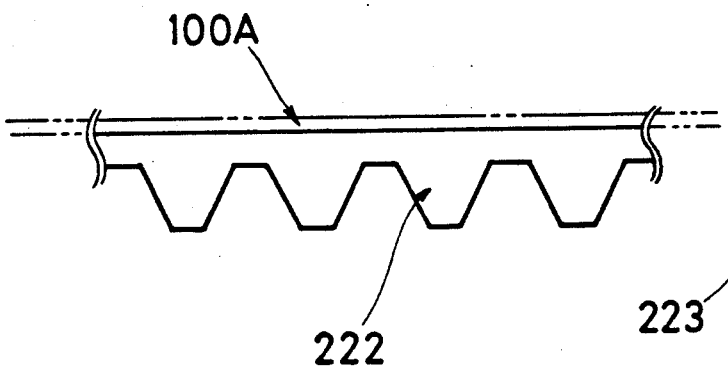
FIG. 9B is a cross-sectional view of a transfer belt means which represents a still further embodiment of the present invention.
Figure 9C:
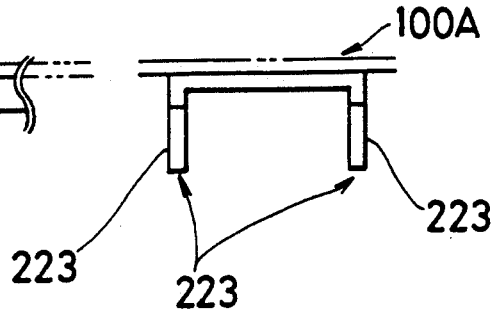
FIG. 9C is a front view of the device shown in FIG. 9B.

The above-described effects can also be achieved by forming the transportation belt from a plastic or the like having a comparatively small friction coefficient and formed in a shape of a rack, as shown in FIGS. 9B and 9C. In this case, side surfaces 203 of the guide groove and side surfaces 223 of the rack 222 serve as limiting portions.

Table 1 shows the results of experiment of the coefficient of friction between the guide rub and the guide groove member and changes in the belt speed with respect to various materials of the guide rib and the guide groove member. In this experiment, the belt 100 was formed of a polyurethane film and the roller rubber layer 202 was formed of a chloroprene rubber (CR). The coefficient of friction between the belt and the roller, i.e., the coefficient $\mu 1$ of friction between the polyurethane resin and CR was 1.2 to 1.4.

TABLE 1

| | Friction coefficient $\mu 2$ | Belt speed change ratio |
|---|---|---|
| Rib a - Groove c | 1.2 to 1.4 | 1 |
| Rib a - Groove d | 0.4 to 0.6 | 0.75 |
| Rib b - Groove c | 0.2 to 0.3 | 0.6 |
| Rib b - Groove d | 0.15 to 0.2 | 0.55 |

a: polyurethane rubber, b: polyurethane rubber with a fluorine-coated surface, c: CR, d: CR with a polyacetal surface.

Friction coefficient values in this experiment represent static friction coefficients. The belt speed change ratio was obtained as a ratio to a change in the speed which was measured when the guide groove was formed of CR and which was assumed to be 1.

As shown in Table 1, the change in the belt speed was reduced by setting $\mu 1 > \mu 2$ compared with the case in which the coefficient $\mu 1$ of friction between the belt and the roller was equal to the coefficient $\mu 2$ of friction between the guide rib and the guide groove member serving as limiting members (the case of Rib a - Groove c).

In the case where the guide rib was formed of polyurethane rubber while the guide rubber member was formed of CR with polyacetal surface (the case of Rib a - Groove d), the belt speed change ratio was limited to 0.65 when the guide groove member was loosely fitted around the shaft, as indicated by the broken line 103 in FIG. 1.

In the case where the guide rib was formed of polyurethane rubber with fluorine-coated surface while the guide rubber member was formed of CR with polyacetal surface (the case of Rib b - Groove d), the belt speed change ratio was limited to 0.5 when the guide groove member was loosely fitted around the shaft, as indicated by the broken line 103 in FIG. 1.

It was thereby confirmed that the arrangements in which the guide groove member was loosely fitted around the shaft was effected because it enabled an improvement in the performance of sliding of the guide groove member and the guide rib, i.e., limiting members on each other.

In the above-described embodiments, the belt represents a transportation belt for transporting a transfer sheet or a recording sheet. However, the present invention can be applied to other types of belts, e.g., a photosensitive material belt and an electrifying belt to which a voltage is applied to charge the sensitive material when the belt contacts the sensitive material. In such an event, the guide rib and the guide groove member or limiting members may also be disposed generally at the center of the belt instead of being disposed at one longitudinal end of the roller as in the case of the above-described embodiments.

In accordance with the embodiment shown in FIG. 3, a transfer sheet is transported to the transfer section of each of a plurality of image forming stations, but it is of course possible to form images on a transfer sheet while superposing the images on each other by using only one image formation station in such a manner that the transfer sheet is transported to the station several times while being supported on an endless belt.

The above-described embodiments have the guide rib and the guide groove provided as a means to limit the movement of the belt in the longitudinal direction of the roller, the guide rib being formed on the belt, the guide groove being formed in the roller. However, the present invention is not limited to this construction. For example, to limit the movement of the belt in the longitudinal direction of the roller, projections 230 may be formed on opposite end portions of the roller, as shown in FIG. 10 in section, or projections 233 may be formed on side portions of the belt wound around the roller, as shown in FIG. 11 in section.

Figure 10:
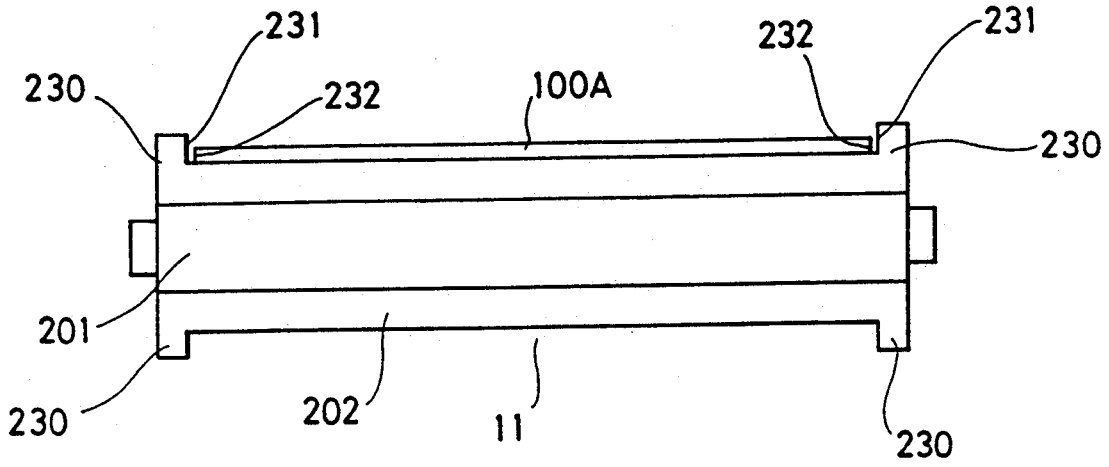
FIGS. 10 and 11 are schematic cross-sectional views each illustrating a roller with a belt wound around the roller which represent a still further embodiment of the present invention.
Figure 11:
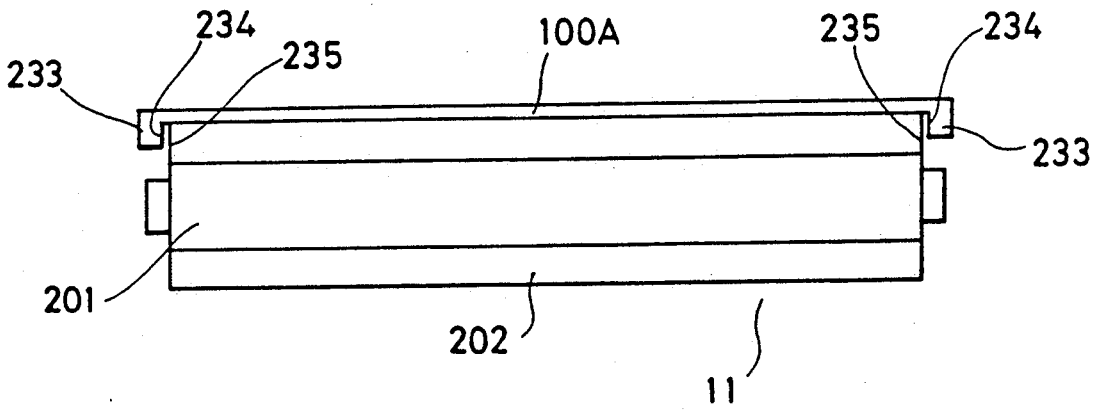

In the arrangement shown in FIG. 10, side surfaces 231 of the projections 230 and side surfaces 232 of the belt serve as limiting portions In the arrangement shown in FIG. 11, side surfaces 234 of the projections 233 and side surfaces 235 of the roller serve as limiting portions Both the arrangements shown in FIGS. 10 and 11 enable the same effects as the former embodiments by making the friction coefficient $\mu 2$ of the limiting portions smaller than the friction coefficient $\mu 1$ of the roller and the belt.

As described above, the present invention makes it possible to limit changes in the belt speed, to prevent offset and meandering of the belt relative to the rotary body around which the belt is wound so as to be supported thereon, and to move the belt stably and smoothly.

What is claimed is:

1. A device having a movable belt, comprising:

said movable belt;

at least one rotary body around which said belt is wound so as to be supported thereon; and limiting means for limiting the movement of said belt in the axial direction of said rotary body, wherein said limiting means includes a rib formed on said belt and a groove formed in said rotary body whereby said rib is guided, said rotary body having a limiting member in which said groove for guiding said rib is formed, the outside diameter of said limiting member in the direction perpendicular to the axis of said rotary body being smaller than the outside diameter of said rotary body, wherein the coefficient of friction of said limiting means at an area where the rib and the groove are in contact with each other in the direction orthogonal to the axial direction of the rotary body is smaller than the coefficient of friction between said belt and said rotary body.

2. A device according to claim 1, wherein said belt is in an endless form.

3. A device according to claim 1, wherein said groove of said rotary body is formed along the direction of rotation of said rotary body while said rib of said belt is formed along the direction of movement of said belt.

4. A device according to claim 1, wherein said limiting means is provided at an axial end of said rotary body.

5. A device according to claim 1, comprising a plurality of rotary bodies.

6. A device according to claim 1, wherein said belt transports a recording medium on which an image is recorded.

7. A device according to claim 6, further comprising an image bearing member, image forming means for forming an image on said image bearing member, transfer means for transferring the image on said image bearing member to the recording medium, wherein said belt transports the recording medium to a transfer section in which said transfer is effected.

8. A device according to claim 7, wherein said belt transports the recording medium to said transfer section a plurality of times so that a plurality of transferred images are formed on the recording medium while being superposed on each other.

9. A device according to claim 7, wherein said limiting means is provided outside a region which is defined with respect to the axial direction of said rotary body and in which recording is effected on a transfer medium.

10. A device according to claim 6, wherein a plurality of images are formed on said recording medium while being superposed on each other.

11. A device according to claim 6, wherein said limiting means is provided outside a region which is defined with respect to the axial direction of said rotary body and in which recording is effected on said recording medium.

12. A device according to claim 1, wherein said rotary body is a rotary body which transmits a driving force to said belt.

* * * * *

UNITED STATES PATENT AND TRADEMARK OFFICE

CERTIFICATE OF CORRECTION

PATENT NO. : 5,017,969

DATED : May 21, 1991

INVENTOR(S) : Mitomi, et al.

It is certified that error appears in the above-identified patent and that said Letters Patent is hereby corrected as shown below:

COLUMN 8,
Line 46, "surface are slide" should read --surfaces are slid--.

COLUMN 9,
Line 27, "guide rub" should read --guide rib--.

COLUMN 10,
Line 44, "portions" should read --portions.--.

Signed and Sealed this

Sixteenth Day of February, 1993

*Attest:*

STEPHEN G. KUNIN

*Attesting Officer*

*Acting Commissioner of Patents and Trademarks*